United States Patent [19]

Kiper et al.

[11] 4,166,399

[45] Sep. 4, 1979

[54] DRIVE DEVICE FOR THE DETACHING ROLLERS IN COMBING MACHINES

[75] Inventors: Gerd Kiper, Springe; Dietmar Schumann, Hanover, both of Fed. Rep. of Germany

[73] Assignee: Schubert & Salzer, Ingolstadt, Fed. Rep. of Germany

[21] Appl. No.: 775,107

[22] Filed: Mar. 7, 1977

[30] Foreign Application Priority Data

Mar. 12, 1976 [DE] Fed. Rep. of Germany ..... 2610314

[51] Int. Cl.[2] ..... G01F 23/06

[52] U.S. Cl. ..... 74/320; 74/665 B; 19/229

[58] Field of Search ..... 19/229, 30, 231, 232; 74/665 A, 665 B, 438, 320, 43

[56] References Cited

U.S. PATENT DOCUMENTS

| | | | |
|---|---|---|---|
| 1,190,407 | 7/1916 | Weinbrenner | 19/232 |
| 1,387,697 | 8/1921 | Edwards | 74/320 |
| 3,232,132 | 2/1966 | Kawamura | 19/231 |

FOREIGN PATENT DOCUMENTS

| | | | |
|---|---|---|---|
| 711882 | 6/1954 | United Kingdom | 19/232 |

*Primary Examiner*—Samuel Scott
*Assistant Examiner*—G. Anderson
*Attorney, Agent, or Firm*—Bailey, Dority & Flint

[57] ABSTRACT

A drive device for the detaching rollers in a combing machine which includes a coupling member having an inner toothed wheel rim with a central axis extending therethrough. A central wheel is carried in the coupling member. The central wheel has an axially located take-off shaft which is used for driving the detaching rollers of the combing machine. Teeth are carried on the central wheel and mesh with the teeth of the inner toothed wheel rim. A first crank arm is provided for reciprocally rotating the coupling member as a second crank arm drives the coupling member about an axis offset from its central axis for imparting a pilgram (about two steps forward and one step back) motion to the take-off shaft of the central wheel.

8 Claims, 4 Drawing Figures

B
3
4
5
7
8
11
14
15
1
D
12
13
23
24
22
21
$A_0$
$\varphi_{12}$
25
26
20
A
27
17
$\varphi$
$C_0$
61
6
16
$B_0$

DRIVE DEVICE FOR THE DETACHING ROLLERS IN COMBING MACHINES

BACKGROUND OF THE INVENTION

The detaching rollers of a combing machine carry out, as is known, two rotational movements which are related to each other in a certain way, namely one in the forward direction in order to separate the combed fiber tuft from a breaker lap and supply it to the take-off roll, and one in the backwards direction in order to deliver back the fiber which needs piecing. It is known to produce this pilgrim step motion (rotating the detaching rollers about twice as far forward as backwards) of the detaching rollers by superimposing a circular and a reciprocating rotational movement using planet wheel differentials. In one device provided with a differential arrangement which is simple in its constructional aspect, the reciprocating movement is produced by means of a preceding cam gear, and is then fed to the planet wheel, (German Auslegeschrift No. 1 008 624).

In the case of higher machine speeds, where the trend for combing machines lies, such a grooved cam gear is however, not suitable because of the unsuitable frictional and tolerance relationships. Furthermore, changing the nature and size of the movement of the detaching rollers is complicated and takes time, since in order to do this, the guide cam in the pinion on the drive shaft has to be changed.

A camless gearing such as disclosed in German Auslegeschrift No. 1 008 624 is relatively expensive compared with the above devices. Furthermore, it needs additional gear members, which among other things, cooperate with each other in two sliding fulcrum pairs and with other gear members. This leads to increased sliding friction, lubrication problems and increased wear. For fast running combing machine, this solution is hence unfavorable.

As already known, a planet wheel differential gear with two planet wheels is also expensive from a constructional point of view since the planet wheels are provided with a to-and-fro reciprocating movement from a crank gear (German Patent No. 237 375). A change of the crank radius and hence the highest values of the reciprocating speed which is imposed on the steady speed is possible with this gearing only coarsly using predetermined steps provided by holes in the crank disk.

SUMMARY OF THE INVENTION

A drive device for the detaching rollers in a combing machine constructed in accordance with the invention, utilizing a pentagon of swivel joints with a coupling member provided with an inner-toothed wheel rim, which member is rotatably connected via a further coupling member with a drive crank which provides it with a reciprocating motion. The inner-toothed wheel rim is guided as the planet of a central wheel which is in engagement with it and acts as a driving member with a second drive crank as a stay. Simple and quick influencing of the characteristic values of the take-off drive motion of the central wheel is achieved by making the effective frame length and/or the effective crank radius of the drive crank which provides the reciprocating motion adjustable. In one embodiment the two drive cranks are connected together via a driving means which is free of play, whereby only one drive motor is required for their drive. The driving means in one embodiment is a toothed belt. Stepless change of the phase situation of the drive cranks in relation to each other is achieved by means of a tensioning lever which is associated with the drive means and which is displaceable with respect to it.

Accordingly, it is an important object of the present invention to provide a drive device for detaching rollers of a combing machine which produces a pilgram motion on a take-off shaft for driving the detaching rollers of the combing machine.

Another important object of the present invention is to provde a drive device for the detaching rollers of a combing machine which is simple in construction and can be used for high speed machines.

Still another important object of the present invention is to provide a drive device for the detaching rollers of a combing machine wherein the reciprocating (pilgram step motion) of the detaching rollers which are driven by a take-off shaft can be adjusted in a simple manner while the machine is running.

These and other object and advantages will become apparent upon reference to the following specification, attendant claims and drawings.

DESCRIPTION OF A PREFERRED EMBODIMENT

Figure 1:
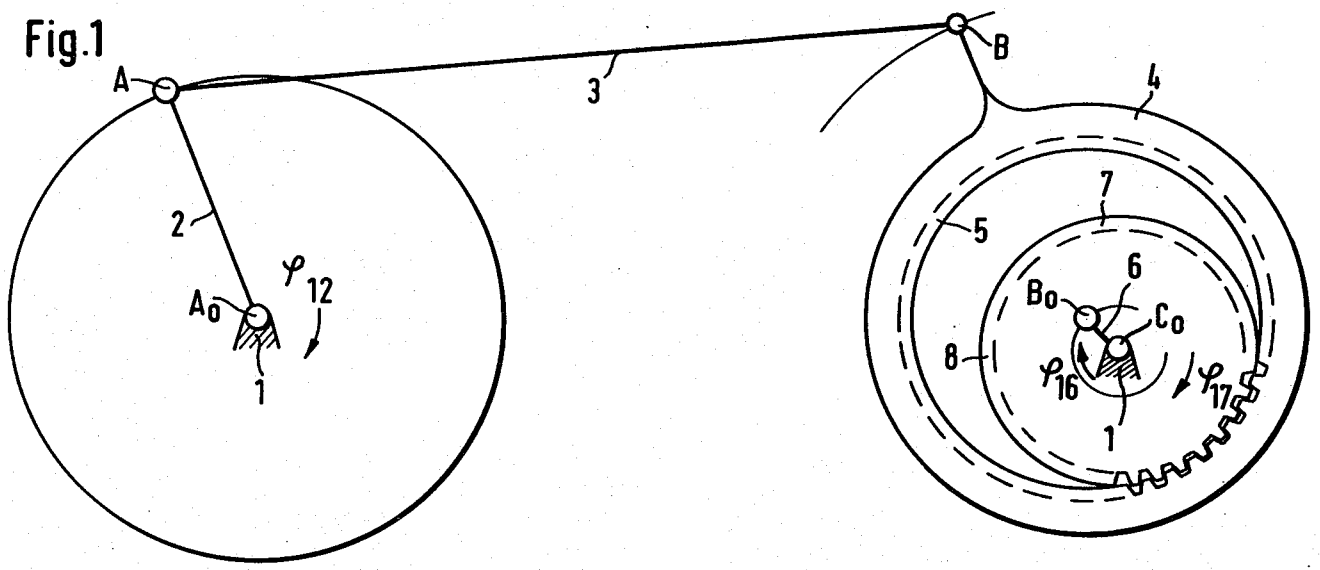
FIG. 1 is a side elevational view partially in schematic form illustrating a drive mechanism for the detaching rolls of a combing machine constructed in accordance with the present invention.
Figure 2:
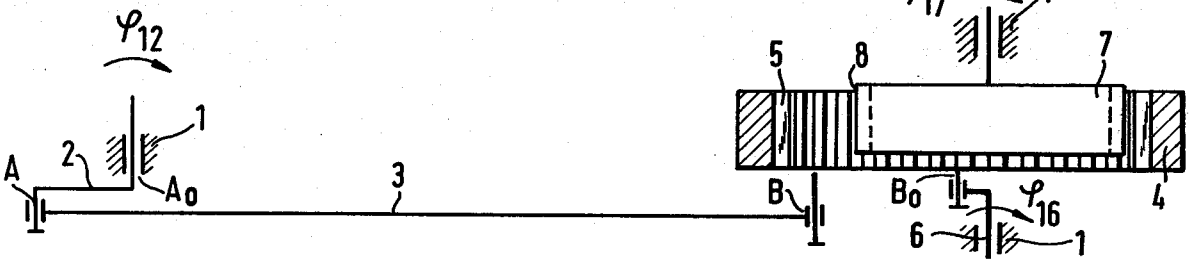
FIG. 2 is a top view of the gearing disclosed in FIG. 1, FIGS. 3 and 4 illustrate in schematic form modified embodiments of the drive devices constructed in accordance with the present invention

According to FIGS. 1 and 2, a first drive crank 2 which is driven at an angular velocity $\phi_{12}$ is pivoted in a linkage $A_O$ in a frame 1. A coupling member 3 is movably connected, by means of the crankpin A of the drive crank 2, with the latter and, by means of a rotating linkage B, with a coupling member 4. The coupling member 4 has an inner-toothed wheel rim 5, which it surrounds, and is rotatably connected with a crankpin $B_O$ of a second drive crank 6 which is pivoted in a linkage $C_O$ of the frame 1. The axis of the inner-toothed wheel rim 5 of the coupling member 4 coincides with the crankpin $B_O$ of the drive crank 6, which is driven at an angular velocity $\phi_{16}$.

A central wheel 7 is pivoted in the frame 1 on the same axis as the drive shaft of the drive crank 6, and has its outer-toothed wheel rim in engagement with the inner-toothed wheel rim 5 of the coupling member. The central wheel 7 acts as a take-off drive which imparts a pilgram step motion with an angular velocity $\phi_{17}$ through shaft *7a* to the detaching rollers which are connected thereto (not shown). The pilgram step motion is a motion wherein the detaching rollers are rotated about twice as far forward as backwards. The rotation for driving of the drive crank 2 which provides the coupling member 4 with a reciprocating rotational motion and for the drive crank 6 which provides the coupling member 4 with a rotational motion, can be provided by two drive motors (not shown) or from one motor via the intermediary of a suitable drive connection. The driving of crank 6 causes the coupling member 4 to be rotated about a second axis which coincides with shaft 7a and is offset from the central axis of the coupling member 4.

The pentagon of swivel joints with the five pivots $A_O$, A, B, $B_O$, $C_O$ formed by the frame 1, the drive cranks 2 and 6 and the coupling members 3 and 4 is a differential gearing with a "degree of running" (Laufgrad) F=2. Its movement is defined by the introduction of two motion components $\phi 12$ and $\phi_{16}$ of the two drive cranks 2 and 6. The resultant movement of each of the coupling members 3 and 4 is then a function of these two motion components. Each of them represents a sum component of the differential gearing. The sum formation which is completed in the differential gearing in the coupling member 4 is transformed by the inner-toothed wheel rim 5 of the coupling member 4 and the outer wheel rim 8 of the central wheel 7 which is in engagement with it, into a directly usable rotational take-off motion. This is obtained by virtue of the fact that the inner-toothed wheel rim 5 of the coupling member 4 is guided as the planet of the central wheel 7 with the drive crank 6 as the stud.

The take-off motion of the central wheel 7 is produced by the superimposition of the rotational driving movements which are fed in from the drive cranks 2 and 6 and depends on the size of the drive revolutions and the dimensions of the gearing. With a whole number gear ratio $i-\phi 16/\phi 12=1, 2, 3, \ldots$ of the two drive cranks 2 and 6, a simple periodicity is produced; with all other gear ratios, a multiple periodicity of the take-off motion is produced.

Figure 3:
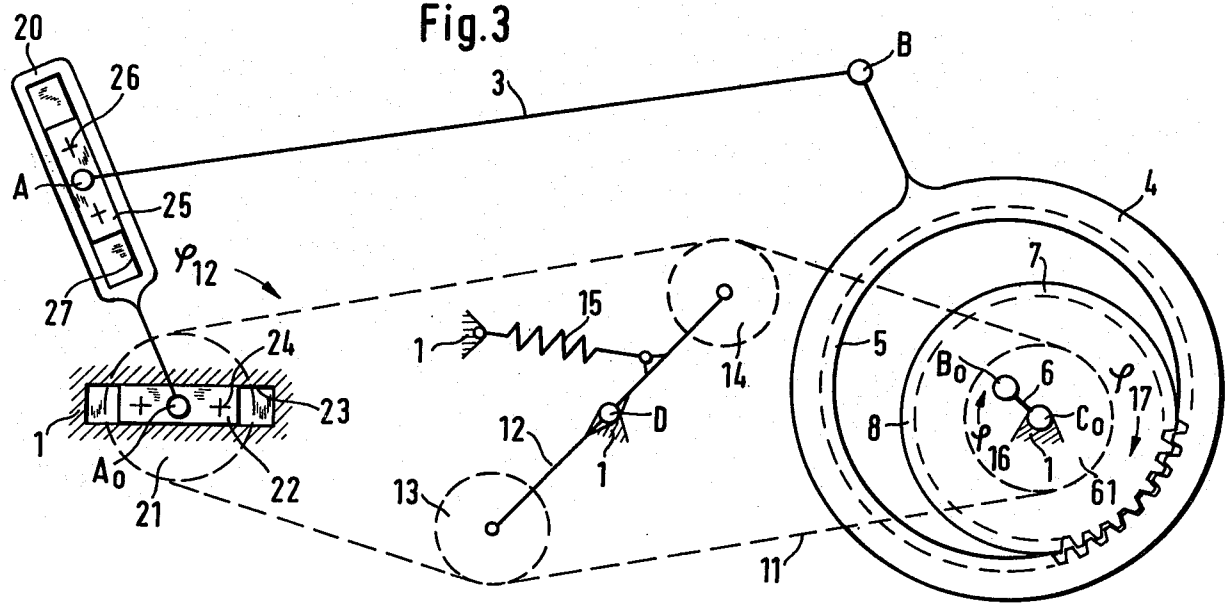

In FIG. 3 there is a modified form of the embodiment of the gearing described above. A drive crank 20 which provides the coupling member 4 with a reciprocating rotational movement is joined to the drive crank 6 via a drive which is free of play. The drive connection is advantageously provided by a toothed belt 11, which is guided over toothed wheels 21 and 61 with the same number of teeth, to which the drive cranks 20 and 6 are rigidly fixed. In this way, a simple periodic take-off motion of the central wheel 7 is produced. The toothed belt is stresses by means of a tensioning lever 12 which has tensioning rollers 12 and 14 mounted thereon. The lever 12 is pivoted in the frame 1 at D, and has a spring 15 attached therebetween. The pivot pin $A_O$ of the drive crank 20 is arranged in a sliding fulcrum pivot 22, which is fixed by means of clamping elements 24 in the slideway 23, and which can be displaced in the slideway after loosening the clamping elements 24. It is possible in this way to steplessly adjust the effective frame length $A_O C_O$. The crank pivot A of the drive crank 20 is also mounted on a sliding fulcrum pivot 25, which, after loosening the clamping elements 26, is slidable in a slideway 27 of the drive crank 20, so that in this way the effective cam radius $A_O A$ of the drive crank 20 which provides the coupling member 4 with its reciprocating rotational movement is steplessly adjustable.

Adjustment of the effective crank radius $A_O A$ results in a large change in the relative reciprocating angle of throw of the coupling member 4 as compared to the drive crank 6. It can easily be carried out using the shown adjusting device while the gearing is at a standstill. Compared to this, the adjustment of the effective frame length $A_O C_O$ only produces a small change in the relative reciprocating angle of throw of the coupling member 4 as compared to the drive crank 6. This can, however, be carried out while the gearing is operating. Each of the possibilities for adjustment influences the characteristic values of the take-off motion of the central wheel 7. Together, they make possible coarse adjustment when the mechanism is at a standstill and fine adjustment while the mechanism is running.

Figure 4:
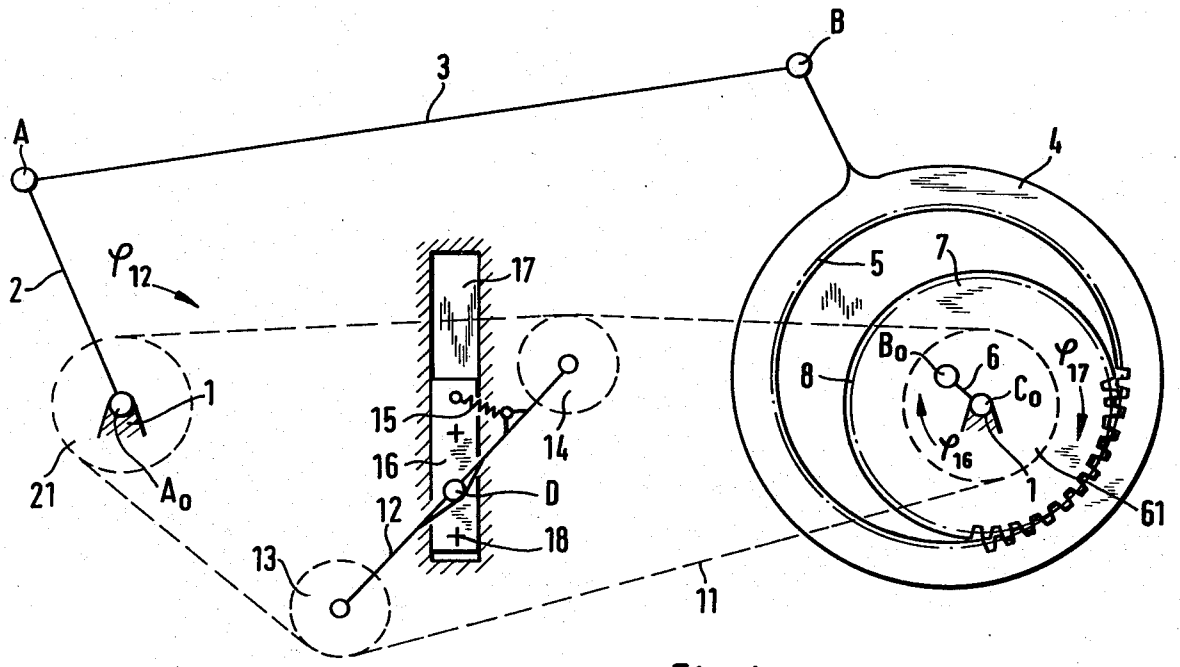

A further way of influencing the characteristic values of the pilgram step movement steplessly and while the mechanism is running is shown in FIG. 4. In this device the tensioning lever 12 is connected at D to a sliding fulcrum pivot 16. Tensioning rollers 13 and 14 are used to tension the tooth belt 11 which, in turn, engages the toothed wheels 21 and 61 which are rigidly fixed to the drive cranks 2 and 6.

The sliding fulcrum pivot 16 is carried in a slideway 17 which is essentially perpendicular to the running direction of the toothed belt 11 and is fixed in it by means of clamping elements 18. After the clamping elements 18 have been slackened, the sliding fulcrum pivot 16 can be displaced in the slideway 17. Such a displacement against the arriving or departing segment of the toothed belt 11 leads to a change in the phase situation of the drive cranks in relation to each other and hence to a change in the characteristic values of the pilgrim step motion. The displaceable mounting of the tensioning arm 12 according to FIG. 4 can obviously find application in the device shown in FIG. 3, just as a stepped change of the phase situation of the drive cranks 2 and 6 in relation to each other in whole multiples of the tooth distribution of the toothed belt transmission can.

The gearing described can undergo modifications. Instead of the toothed belt 11, another drive means which is free to play may be used, for example, a chain may be used. In the same way, the coupling member 3 can be shortened, which yields a particularly space-saving compact construction.

What is claimed:

1. A drive device for the detaching rollers in a combing machine comprising:
   (a) a coupling member having an inner toothed wheel rim with a central axis extending therethrough;
   (b) a central wheel carried in said coupling member;
   (c) a take-off shaft carried by said central wheel for driving said detaching rollers;
   (d) teeth carried on said central wheel meshing with said teeth of said inner toothed wheel rim;
   (e) crank arm means for driving said coupling member about a second axis offset from said central axis, and
   (f) means for reciprocally rotating said coupling member as said crank means drives said coupling member about said second axis for imparting a pilgram step motion to said take-off shaft of said central wheel.

2. A drive device as set forth in claim 1 wherein said means for reciprocally rotating said coupling member comprises:
   (a) a coupling arm having one end pivotally connected to said coupling member;
   (b) a pivot joint carried on the other end of said coupling member; and
   (c) means for moving said pivot joint in a closed arcuate path.

3. The drive device as set forth in claim 2 wherein said means for moving said pivot joint comprises:
   (a) another crank arm having an inner shaft and a radially displaced outer shaft;
   (b) said pivot joint being carried on said outer shaft; and (c) means for rotating said inner shaft of said another crank arm causing said pivot joint to be moved in a circular path.

4. The drive device as set forth in claim 2 further comprising:

means for adjusting the radius of said closed arcuate path through which said pivot joint is moved.

5. The drive device as set forth in claim 3 further comprising:

means for coupling said crank arm means and said another crank arm together so that they are rotated at the same rate.

6. The drive device as set forth in claim 5 wherein said means for coupling said crank arm means and said another crank arm together includes a toothed belt.

7. The drive device as set forth in claim 6 further comprising:

(a) an adjustable tension lever means engaging said toothed belt for maintaining a desired tension therein.

8. The drive device as set forth in claim 5 further comprising:

(a) means for adjusting the distance between said crank arm means and said another crank arm for modifying said pilgram step motion imparted to said take-off shaft.

* * * * *